US006848989B2

(12) United States Patent
Miyazaki et al.

(10) Patent No.: US 6,848,989 B2
(45) Date of Patent: Feb. 1, 2005

(54) ENVIRONMENTAL IMPROVEMENT DEVICE FOR A STORAGE BODY

(75) Inventors: Kunio Miyazaki, Kumamoto (JP); Tomoyuki Kawano, Kumamoto (JP); Ichiro Ikenaga, Kumamoto (JP); Kazuya Tokunaga, Kumamoto (JP); Toshihiro Higashi, Kumamoto (JP); Hiroaki Koba, Kumamoto (JP)

(73) Assignee: Kongo Kabushiki Kaisha, Kumamoto (JP)

( * ) Notice: Subject to any disclaimer, the term of this patent is extended or adjusted under 35 U.S.C. 154(b) by 54 days.

(21) Appl. No.: 10/249,937

(22) Filed: May 20, 2003

(65) Prior Publication Data

US 2004/0166796 A1 Aug. 26, 2004

Related U.S. Application Data

(63) Continuation-in-part of application No. 10/416,425, filed on May 8, 2003.

(30) Foreign Application Priority Data

May 27, 2002 (JP) ..... 2002-152406
May 29, 2002 (JP) ..... PCT/JP02/05184

(51) Int. Cl.[7] ..... H05K 5/00
(52) U.S. Cl. ..... 454/184; 361/695

(58) Field of Search ..... 454/184, 185, 454/195; 361/695, 696; 165/122, 80.2, 104.33; 312/236

(56) References Cited

U.S. PATENT DOCUMENTS

| | | | | |
|---|---|---|---|---|
| 5,544,012 A | * | 8/1996 | Koike | 361/695 |
| 5,851,143 A | * | 12/1998 | Hamid | 454/57 |
| 6,059,196 A | | 5/2000 | Miyazaki et al. | |
| 6,098,529 A | * | 8/2000 | Brummett et al. | 99/467 |
| 6,463,997 B1 | * | 10/2002 | Nicolai et al. | 165/80.2 |
| 6,544,311 B1 | * | 4/2003 | Walton et al. | 55/385.6 |
| 6,643,123 B2 | * | 11/2003 | Hartel et al. | 361/678 |

FOREIGN PATENT DOCUMENTS

| | | |
|---|---|---|
| GB | 2198220 A | 6/1988 |
| JP | 6-30734 | 8/1994 |
| JP | 2000-14460 A | 1/2000 |
| JP | 2001-95632 | 4/2001 |
| WO | WO96/08681 | 3/1996 |

* cited by examiner

*Primary Examiner*—Derek S. Boles
(74) *Attorney, Agent, or Firm*—Ernest A Beutler

(57) ABSTRACT

An environmental improvement device for a storage body and more particularly to a simplified, but highly effective device of that type wherein the stored articles are protected by a circulating flow of purified air that also prevents the entry of foreign objects into the storage area.

14 Claims, 12 Drawing Sheets

Comparison of number of air changes

| | Number of air outlets/side | | | | | | | | | |
|---|---|---|---|---|---|---|---|---|---|---|
| | #2 | #3 | #4 | #5 | #6 | #7 | #8 | #9 | #10 | Total |
| Curve a | 15 | 15 | 15 | 15 | 15 | 15 | 15 | 15 | 15 | 135 |
| Curve b | 20 | 20 | 20 | 20 | 20 | 20 | 20 | 20 | 20 | 180 |
| Curve c | 40 | 40 | 40 | 40 | 40 | 40 | 40 | 40 | 40 | 360 |
| Curve d | 10 | 10 | 40 | 40 | 40 | 40 | 40 | 40 | 40 | 300 |
| Curve e | 15 | 15 | 40 | 40 | 40 | 40 | 40 | 40 | 40 | 310 |
| Curve f | 20 | 20 | 40 | 40 | 40 | 40 | 40 | 40 | 40 | 320 |

Comparison between air outlet specifications

ENVIRONMENTAL IMPROVEMENT DEVICE FOR A STORAGE BODY

CROSS REFERENCE TO RELATED APPLICATIONS

This application is a continuation in part of the copending application entitled, "STORAGE WITH AIR PURIFICATION FUNCTION", Ser. No. 10/416,425, filed May 8, 2003, filed in the names of several of the inventors hereof and others, and assigned to the assignee hereof.

BACKGROUND OF INVENTION

This invention relates to an environmental improvement device for a storage body and more particularly to a simplified, but highly effective device of that type.

As is noted in the aforenoted copending application there are a wide variety of storage devices utilized for a variety of purposes such as movable and fixed shelves, cabinets, showcases, closets, shoe boxes, storerooms and the like. These storage devices are widely used in libraries, cultural properties depositories, archives, museums, storerooms, warehouses, hospitals, basement storages, art museums, shops, department stores, supermarkets, public rest rooms, and the like.

These devices may be comprised of an open type storage having a structure that the opening of the storage section is always opened or a closed type storage having a door for opening and closing the opening. With the open type storage the extra space for opening and closing the door is not necessary, and the door does not interfere with taking the stored object in and out. On the other hand, through the opening of the storage section, particles such as fungus spores, bacterium, pollen, dusts, and dead bodies of ticks floating in the air, and harmful insects such as moths and spiders easily invade in the storage section.

Although the closed type storage can prevent the invasion of the particles, harmful insects, or the like described above it is still difficult to prevent the invasion of the particles, harmful insects, due to opening and closing of the door for insertion or removal of articles. In addition the closed type storage shuts out the exchange of the air so that the air in the storage area is easily polluted.

The aforenoted copending application solves many of these problems by providing an air purification that effects an air circulation means within the storage area through intake and delivery passages with an air filter for purifying the air circulated. In addition a flowing air curtain is formed across the opening to the storage area to preclude insects and other foreign matter from entering the storage area. Although the embodiments disclosed therein are very effective, further improvements are possible and such improvements are disclosed herein.

For example the embodiments disclosed therein provide somewhat complicated flow paths making it difficult to control the air flow velocity and direction. Also they do not provide for maintance of the proper humidity condition for the protection of the stored articles.

It is therefore a principle object of this invention to provide an improved air circulation arrangement for a storage device that controls accurately and simply the air curtain around an open storage device.

It is a further object of the invention to provide a humidity control for such a storage device.

SUMMARY OF INVENTION

A first feature of the invention is adapted to be embodied in a storage device having air purification. The storage device comprises a storage area for storing a stored object and an access opening for placing the stored object within the storage area and for removing the stored object therefrom. The access opening is defined by horizontally spaced members and attached, vertically spaced members. At least one of the members defines an air flow path comprised of an inlet path including a plurality of spaced inlet openings for drawing atmospheric air into the at least one of the members and an outlet path including a plurality of spaced outlet openings for exhausting atmospheric air introduced in the inlet path from the inlet air opening. An air purification system is provided that includes at least a device for circulating atmospheric air through the inlet path and the outlet path and an air purification device in the path of the circulated atmospheric air.

Another feature of the invention is adapted to be embodied in a storage device having air purification. The storage device comprises a storage area for storing a stored object and an access opening for placing the stored object within the storage area and for removing the stored object therefrom. The air purification comprises an inlet path including an inlet air opening for drawing atmospheric air into the storage device, an outlet path including an outlet air opening for exhausting atmospheric air introduced in the inlet path from the inlet air opening. The air purification system includes at least a device for circulating atmospheric air through the inlet path and the outlet path, an air purification device in the path of the circulated atmospheric air and a humidifying element controlling the relative humidity of the circulated air.

DETAILED DESCRIPTION

Figure 1:
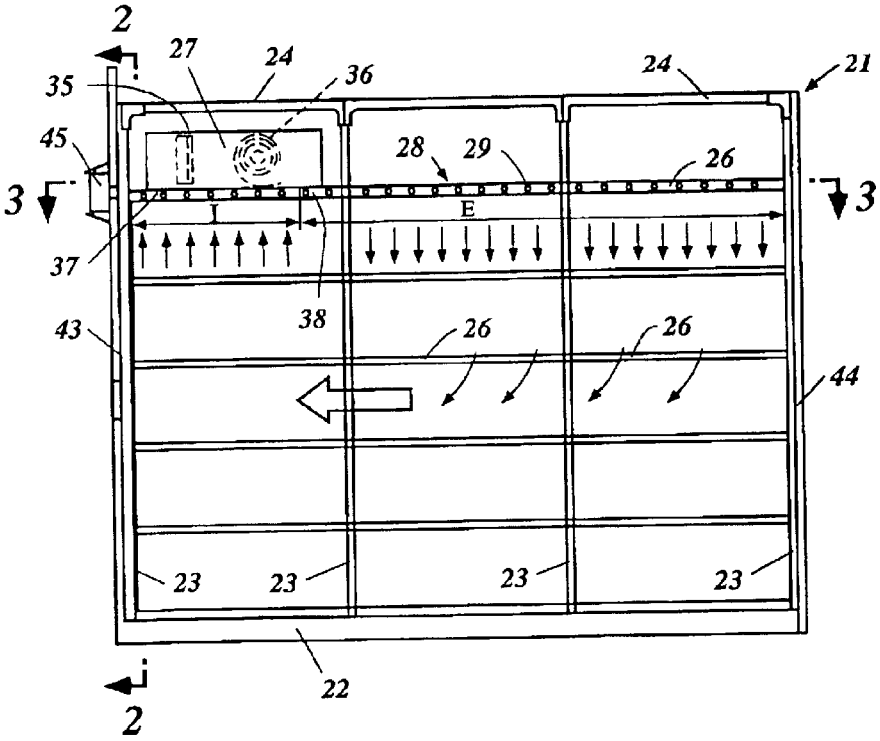
FIG. 1 is a front elevational view of a storage device constructed in accordance with a first embodiment of the invention.
Figure 2:
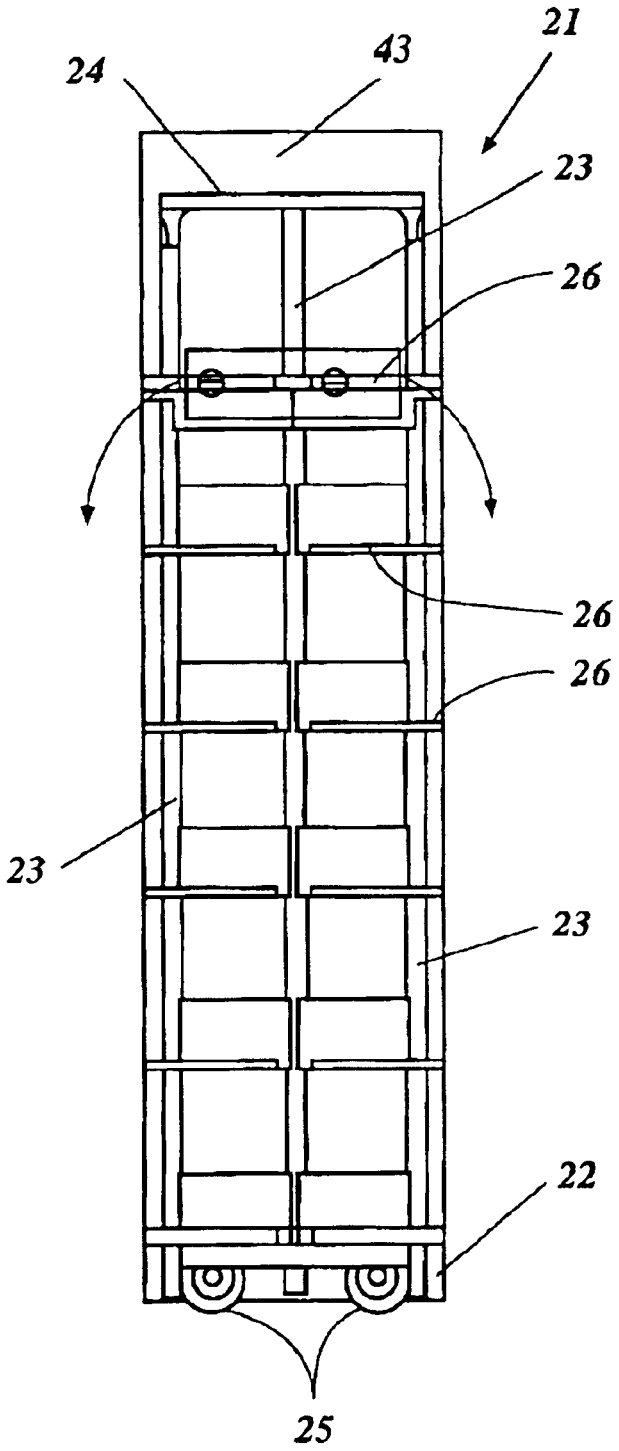
FIG. 2 is a cross sectional view taken along the line 2—2 in FIG. 1.

Referring now in detail to the drawings and initially to the embodiment of FIGS. 1–8, a storage body in the form of a rack, indicated generally by the reference numeral 21, is illustrated. The rack 21 is formed from a plurality of interconnected members supported on a base frame 22 as a base member. Supported on the top of the base frame 22, are a plurality spaced, parallel posts 23in fixed relation on the base frame 22. Top plates 24 connect the upper ends of the posts 23.

The illustrated embodiment is a so called three-section type rack 21 is formed in which four posts 23 are set up at regular intervals when viewed from the front of the rack 21forming rectangular openings through which articles may taken in and out. Also, the rack constitutes a double-front type rack in which three posts 23 are set up when viewed from the side of the rack 21, thus the article storage space is divided by the center posts 23, and openings which articles may taken in and out, are formed on both front and rear sides of the rack 21.

As a matter of course, the application of this invention is not limited to the double-front type rack and a rack may be used in which a face at which articles may taken in and out is provided on only one side of the rack. Also although this embodiment shows a moving rack capable of moving with running wheels 25 provided on the base frame 22, this invention may also be applied to a stationary rack.

Adjacent four posts 23 located at corners of a rectangle in plan view, support a plurality of vertically spaced rack plate members26. Any support structure can be used, and for example, a structure may be adopted in which rack plate members 26 are provided between posts arranged in the direction of depth of the rack and the rack plate members 26are supported by a pair of left and right arm plates viewed from the side of a face at which article are taken in and out. The rack plate members26 are provided vertically in several tiers.

In accordance with this embodiment, an air purifier, indicated generally by the reference numeral 27 is supported and on the uppermost rack plate member26 located at the left side on FIG. 1. The rack plate member having the air purifier 27 mounted thereon is located at the same height as other rack plate members26to form an air duct, indicated generally at28, in a manner as will be described. This air duct 28 includes a delivery passage 29 and an intake passage 31. The air duct 28 is in itself one continuous air passage extending in the horizontal direction and is divided in the manner next to be described into the delivery passage 29 and the intake passage 31.

Figure 5:
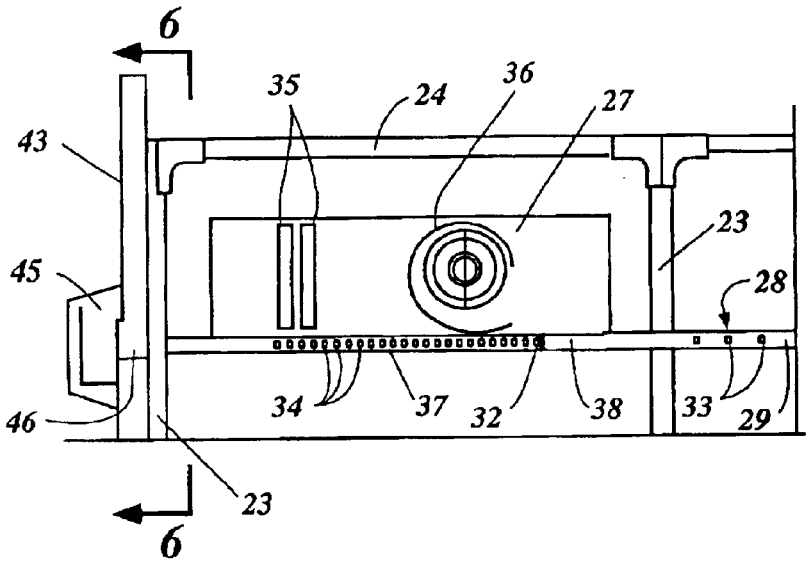
FIG. 5 is an enlarged view of the upper left hand portion of FIG. 1.
Figure 6:
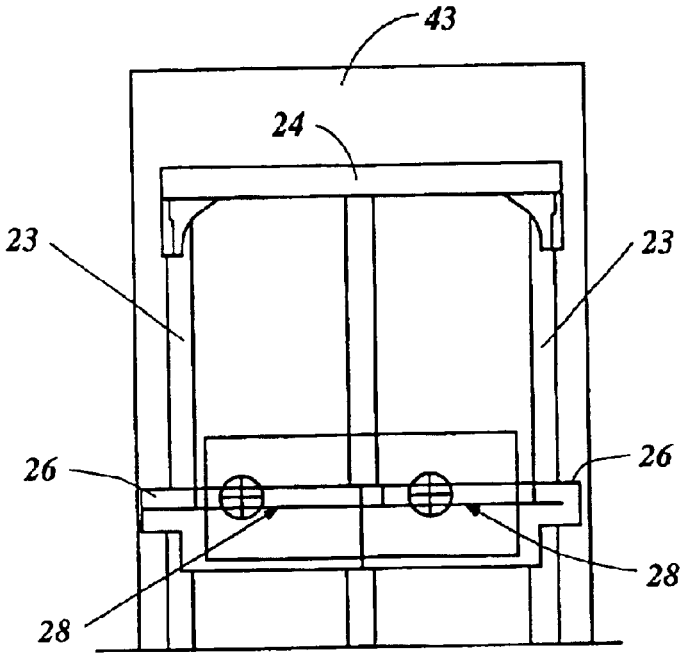
FIG. 6 is an enlarged view of the upper portion of FIG. 2.
Figure 8:
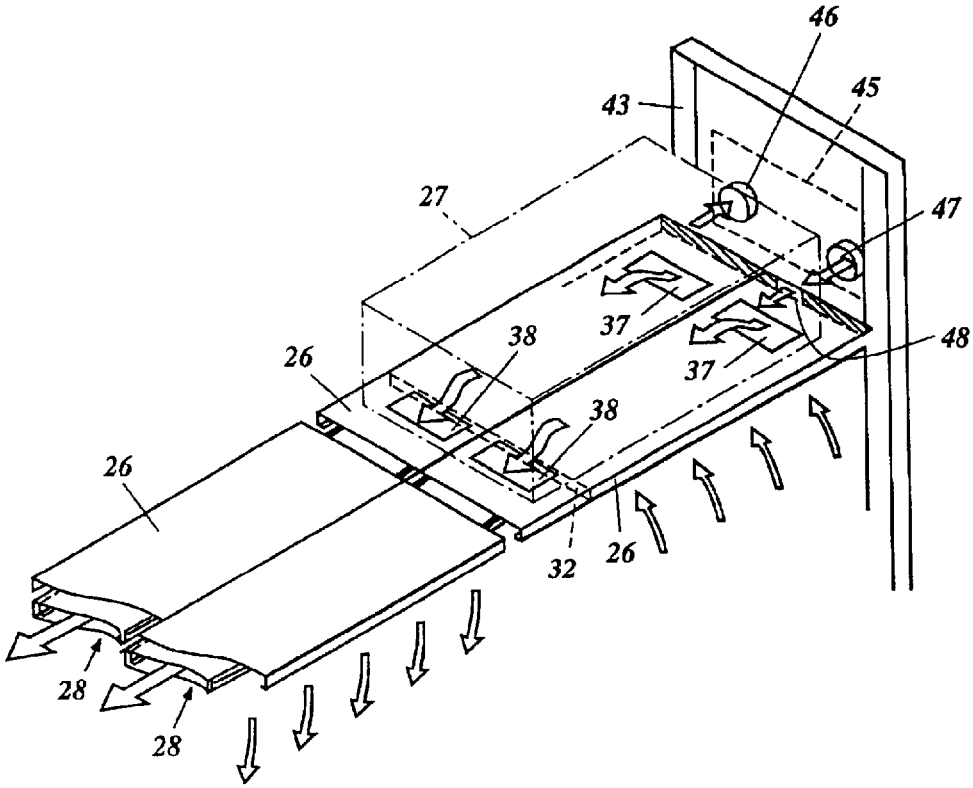
FIG. 8 is a partially cut away perspective view of the air duct and air purifying device looking in the opposite direction from FIG. 7.

As shown in FIGS. 5 and 8, the air duct 28 is divided by an air shutter 32 into the delivery passage 29 and the intake passage 31. This air shutter 32 is placed in the left hand rack plate member26 on which the air purifier 27 is mounted. The delivery passage 29 is formed with a plurality of air outlets 33 arranged in the front and rear faces of the rack plate members 26 forming the air duct 28 on right hand side of the shutter as viewed in FIG. 1.

Figure 3:
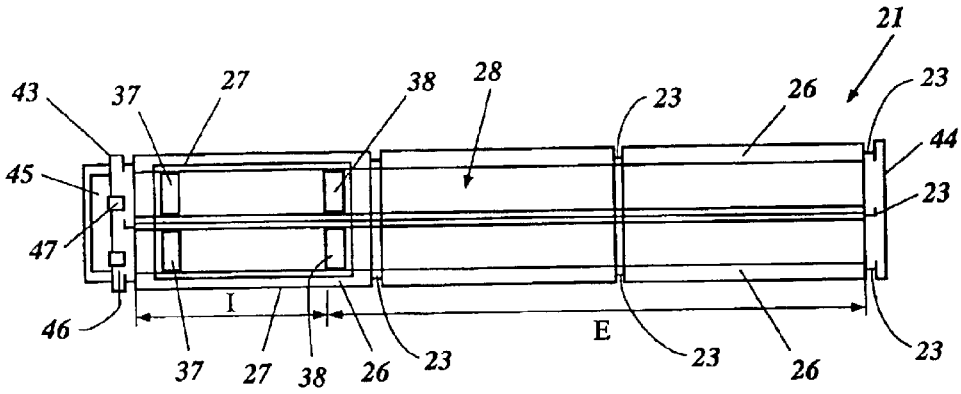
FIG. 3 is a cross sectional view taken along the line 3—3 in FIG. 1.

On the other side of the shutter 32 the intake passage 31 with a plurality of air inlets 34 arranged in the front and rear faces of the rack plate members 26 forming the air duct 28. In FIGS. 1 and 3, the symbol E designates a range in which the air outlets 33 are formed and symbol I a range in which the air inlets 34 are formed.

The air purifier 27 sends air drawn from the air inlets 34 of the intake passage 31 into the delivery passage 29 after purification and discharges it from the air outlets 33. The air purifier 27 has, for example, a titanium oxide filter 35 (FIGS. 1 and 5) as photo catalyst, that adsorbs and decomposes minute dust floating in the air for decontamination and sterilization. A fan 36 effects the air circulation.

Figure 4:
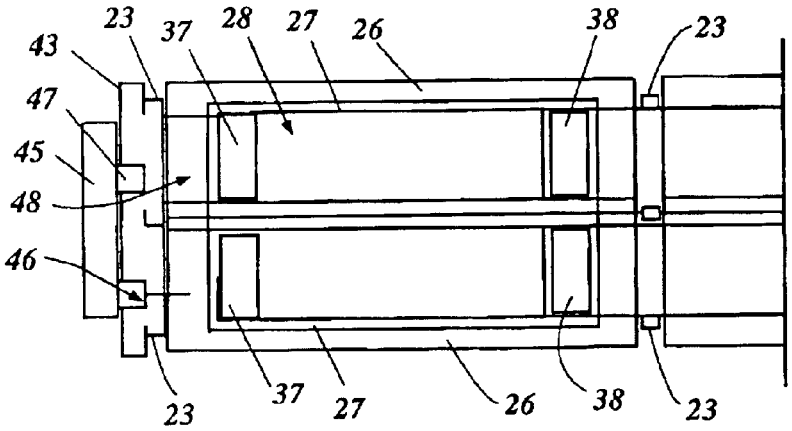
FIG. 4 is an enlarged view of the left hand side of FIG. 3 showing the air purifying device.

As seen in FIGS. 3, 4 and 8 the reference numeral 37 designates air inlets of the air purifier 27, which is in communication with the intake passage 31 and is located upstream of the titanium oxide filter 35 and fan 36. The reference numeral 38 designates the air outlet of the air purifier 27, which is in communication with one end of the delivery passage 29 and lies on the other side of the shutter 32.

In the embodiment is shown in the figures as being a double-front type rack as aforementioned and the air ducts 28 and the air purifiers 27 are incorporated separately in the rack plate members26 arranged in two rows in the direction of depth of the rack. At the front side of each of the rack plate members26 arranged in two rows, that is, at the side of the face at which articles are taken in and out, purified air is discharged horizontally outwardly from the plurality of air outlets 33 of the delivery passage 29, and air around the air inlets is drawn horizontally inwardly through the plurality of air inlets 34 of the intake passage 31.

Figure 7:
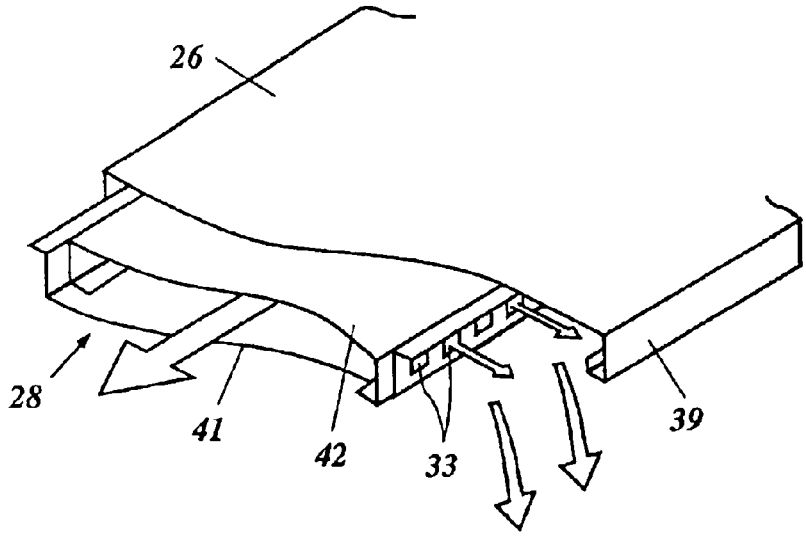
FIG. 7 is a partially cut away perspective view of the air duct.

The shape and construction of the air duct 28 is best shown in FIGS. 7 and 8. As also seen in these figures, the rack plate members26 incorporating the air duct 28 has an upper plate including a vertical walls39 formed at least on the sides of the face at which articles are taken in and out. These walls 39 face both the inlet openings 34 and discharge openings 33 so that the air flow path is turned from the horizontal direction to a vertical direction as shown by the arrows in FIGS. 1, 2, 7 and 8.

As seen best in FIGS. 7 and 8, the air duct 28 is formed on the underside of the upper rack plate members 26, by a sheet metal member 41 of hat-like cross-section and a flat channel-like member 42 being fitted together. The air inlet openings 34 and discharge openings 33 are formed in this assembly.

Although in the embodiment shown in FIG. 1 to FIG. 8, the air duct 28 is formed inside the rack plate members26 which are provided continuously in the lateral direction at the same height and the air purifier 27 is mounted on one of these rack plate members 26, the air duct 28 and the air purifier 27 may be incorporated in the top plates 24. The shape of the air duct incorporated in the top plates 24 may be the same as that shown in FIGS. 7 and 8.

Further, the air duct 28 and the air purifier 27 may be incorporated in the base frame 22. In this case, it is preferable that the air outlets discharge air upwardly and the air inlets draw air from below.

In this embodiment, the reference numerals 43 and 44 designate side panels attached to the sides of the rack 21.

In addition to the filter 35, the air purification also includes a humidity controller, indicated generally by the, reference numeral 45 (FIGS. 3–5 and 8). The humidity controller 45 is attached to the side panel 43 and has an intake port 46 and a discharge port 47 at the inner side of the side panel 43. Part of air inside the rack collected around the intake passage 31 is drawn from the intake port 46 and dehumidified or humidified as the case may be. The air humidity-controlled by the humidifier 45 is delivered from the discharge port through a communication passage 48 to the intake passage 31 and purified by the air purifier 27, together with air drawn from the air inlets 34, to be sent into the delivery passage 29 so that a proper humidity environment of the rack 21 is maintained. Provision of the humidity controller 45 is optional.

In the embodiment as described above, the air duct 28 is configured, in a simple structure, extending horizontally and divided by an air shutter 32 into the delivery passage 29 and the intake passage 31, with the air purifier 27 is directly connected to the delivery passage 29. Therefore, air purified by the air purifier 27 is introduced efficiently with adequate volume to the delivery passage 29 of the air duct 28 and discharged from the air outlets 33. Thus, a curtain of air is formed around the rack 21 and in the article storage area can be circulated efficiently and the air circulation cycle/unit time can be increased, so that the environment around the rack 21 and in the article storage area can be improved rapidly.

The air duct 28 is incorporated integrally in the rack plate members 26 with the additional plates 41 and 42, so that the number of parts is reduced. One continuous duct 28 is divided by the air shutter 32 into the delivery passage 29 and the intake passage 31, so that the environment improvement device for a storage body can be obtained at low cost and with simple structure. Further, if the air duct 28 is incorporated integrally in the rack plate members26 or the top plate 24, even for a multiple-section type storage body in which the posts 23 is adapted to divide a face at which articles are taken in and out, into a plurality of sections, the air duct 28 can be formed continuously extending over the rack plate members26 or the top plates 24 of the plurality of sections, thereby facilitating the formation of the air duct 28.

The performance of this invention will be described in conjunction with various kinds of measurement data obtained when this invention is adopted by reference to the graphical views of FIGS. 9–12. It is believed to be undesirable that if storage articles are exposed directly to a wind running at a speed larger than about 0.5 m/sec because the water content of the stored articles varies in response to changes in relative humidity too rapidly. Thus, the device has been developed and designed with a target of the wind velocity being 0.5 m/sec or lower when the wind blows directly against the storage articles.

Therefore, as shown, the number of the air outlets 33 is increased to reduce the air speed at which air is discharged from the air outlets 33. In addition, as illustrated in FIGS. 7 and 8, the device is configured such that air discharged horizontally from the air outlets 33 is made to hit against the frame walls 39 of the rack plate members 26 to decrease its wind velocity, the wind is turned downwardly, and direct blow of a strong wind against the storage articles is avoided. This prevents damage to the storage articles from which the wind is subjected.

Figure 9:
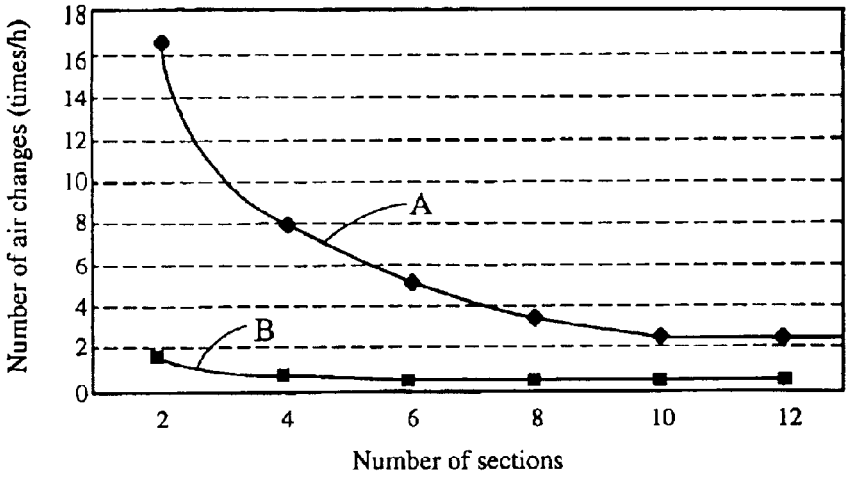
FIG. 9 is a graphical view showing, in comparison, the number of air changes/unit time of a storage body incorporating the concept of this invention and that incorporating the concept of the invention of the aforenoted copending application.

The number of air changes per unit time in the case where technical concept of this invention is adopted, is compared with the case where the invention of the prior mentioned copending patent application is shown in FIG. 9. Racks with a frontage of 12 sections are selected as objects, and measurement is made at the 2nd, 4th, 6th, 8th, 10th and 12th section. In FIG. 9, curve A shows the case where the technical concept of this invention is adopted and curve B the case where the invention of the prior patent application is adopted. As is clear from the curves A and B, when the technical concept of this invention is adopted, the value of the number of air changes per unit time is, at every measuring point, ten times as large as that according to the invention of the prior patent application, thus showing a high environment improvement efficiency.

Figure 10:
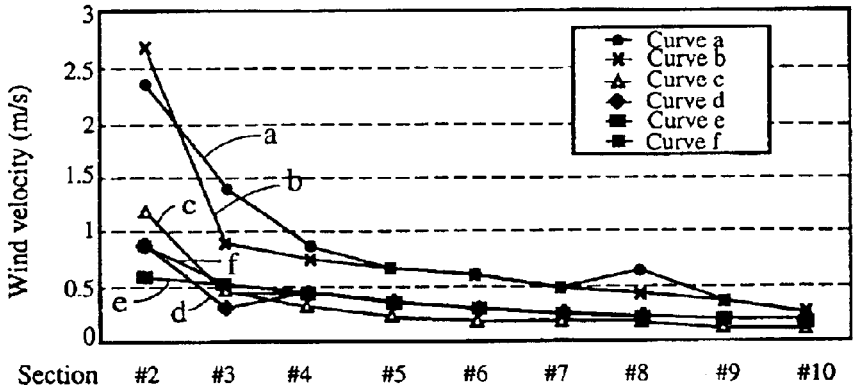
FIG. 10 is a graphical view showing the wind velocity, for varying specifications, obtained with storage bodies incorporating the invention.

The wind velocity at the air outlets 33 in the case where the technical concept of this invention is adopted, was measured with the number of the air outlets 33 being changed. Racks to be measured are of 10-section type and measurement is made at each section. The diameter of the air outlet is 10 mm. In FIG. 10, curve a shows a result of the measurement for the specification of all 15 air outlets/section; curve b for the specification of all 20 air outlets/section; curve c for the specification of all 40 air outlets/section; curve d for the specification of 10 air outlets/section for each of 2nd and 3rd sections and 40 air outlets/section for each of 4th–10th sections; curve e for the specification of 15 air outlets/section for each of 2nd and 3rd sections and 40 air outlets/section for each of 4th–10th sections; and curve f for the specification of 20 air outlets/section for each of 2nd and 3rd sections and 40 air outlets/section for each of 4th–10th sections. A wind source or an air purifier is provided on the first section. As seen from the result, a measuring point nearer to the wind source provides a faster wind velocity. In particular, on the whole, the wind velocity is faster for a smaller number of air outlets and becomes unfavorably faster for a measuring point nearer to the wind source. In addition, it is found that if the number of air outlets is decreased at a location near the wind source and increased at a location remote from the wind source, a uniform wind velocity can be obtained as a whole.

Among rack specifications measured, the specification of 15 air outlets/section for each of 2nd and 3rd sections and 40 air outlets/section for each of 4th–10th sections, for which the curve e is obtained, most preferably achieves the wind velocity of about 0.5 m/sec or lower as a whole.

Figure 11:
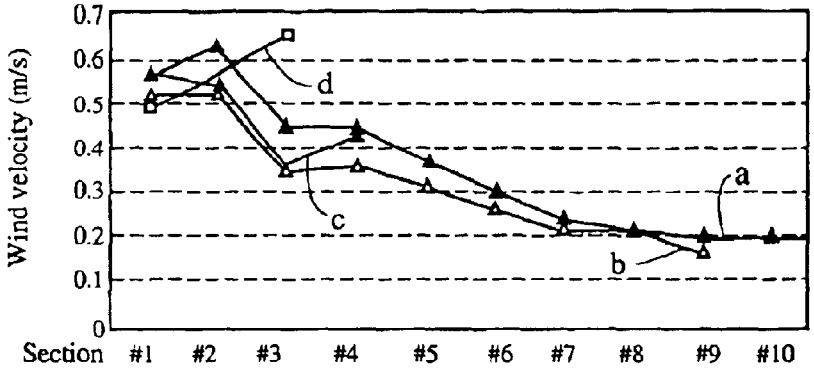
FIG. 11 is a graphical view showing the wind velocity in particular specification conditions, for each storage body of having different numbers of sections.

Then, racks with a specification of 15 or 40 air outlets/section were measured with the number of sections being changed and the result is shown in FIG. 11. Curve a shows a result of the measurement for a rack of 10 sections, curve b for a rack of 9 sections, curve c for a rack of 6 sections and curve d for a rack of 3 sections. In all the rack specifications, the target of the wind velocity of 0.5 m/sec or lower is achieved.

Figure 12:
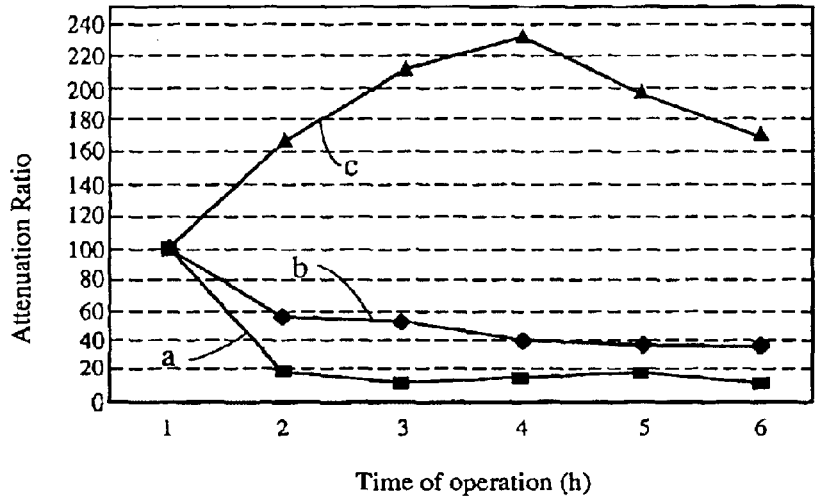
FIG. 12 is a graphical view showing, in comparison, the test result of the decontamination effect of a storage body incorporating the concept of this invention.

FIG. 12 shows the test result of the decontamination effect. Petri dishes of 90 mm diameter each containing a mold culture medium, were placed at five locations inside and outside a rack and the falling bacteria test is performed in purposeful and adverse conditions. Falling bacteria are sampled at certain intervals of elapsed time after operation of the air purifier, for culture detection. In the figure, curve a shows the value detected inside a rack incorporating the concept of this invention, curve b the value detected inside a rack incorporating the concept of the invention of the prior patent application, and curve c the value detected outside a rack. The horizontal axis represents the time of operation and the vertical axis the attenuation ratio. As seen from FIG. 12, although the rack incorporating the concept of the invention of the prior patent application also has an excellent decontamination effect, the rack incorporating the concept of this invention has a more excellent decontamination effect.

Also, in the rack incorporating the concept of this invention, it was found that a rack which was in a strong acid environment before operation, is improved to have a neutral environment, that is, a clean environment 24 hours after operation. This acidity and alkalinity environment measurement was performed such that environment monitors are provided inside the article storage blocks of each rack and change in color is compared to a color scale for judgment.

As a result of the measurement, although an environment improvement effect is recognized for the rack incorporating the concept of the invention of the prior patent application, it is found that the rack incorporating the concept of this invention has a higher environment improvement effect because a strong acidity before operation is turned to a week one 24 hours after operation.

In the rack incorporating the concept of this invention, since the inside of the storage body is air-conditioned at all times for the control of temperature and humidity, storage spaces for articles are maintained in a stable environment condition. In addition, if a humidity controller is provided in the rack, humidity is maintained in an even better condition.

Although in the embodiment of FIGS. 1–9, the air duct extends horizontally, this invention is not limited to that. The air duct may extend vertically, the delivery passage may extend vertically or horizontally and the intake passage may extend horizontally or vertically. Now, embodiments having such structures will be described below.

Figure 13:
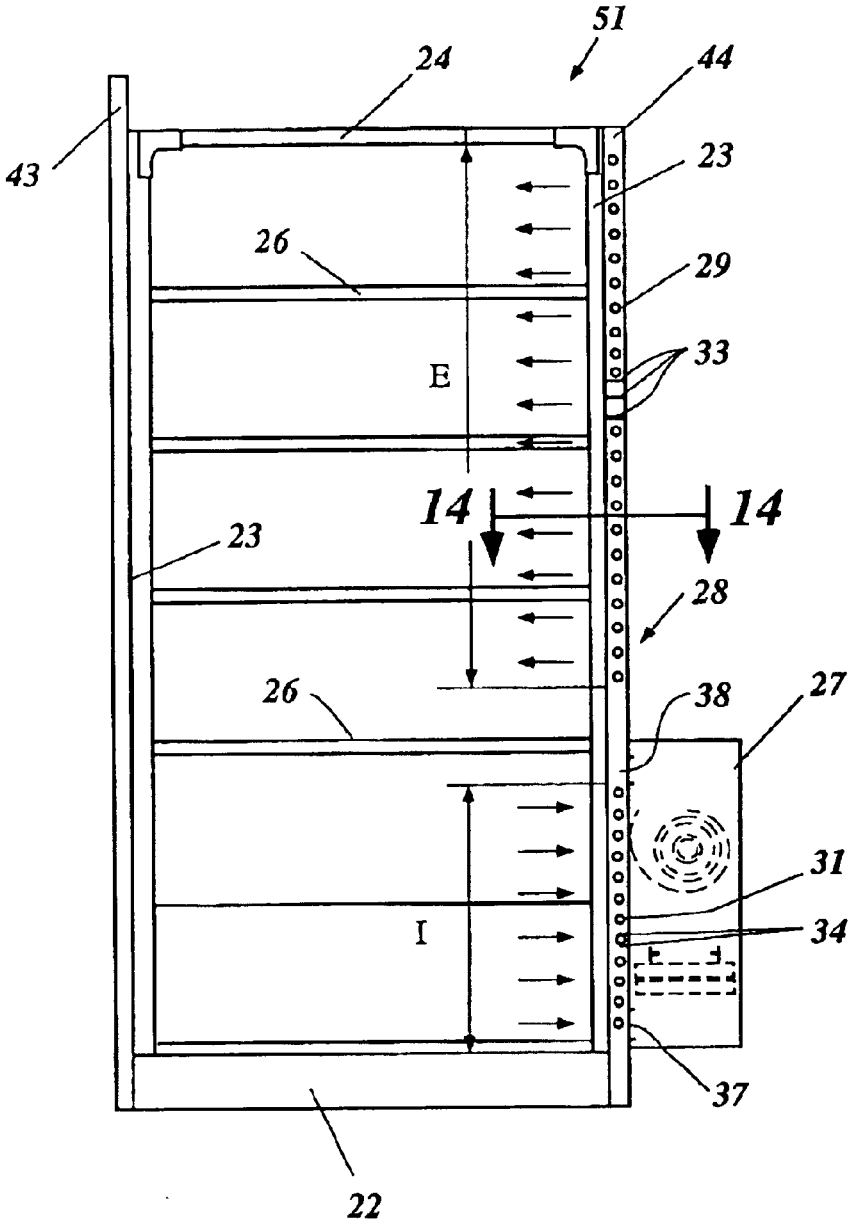
FIG. 13 is a front elevational view, in part similar to FIG. 1, but showing a second embodiment of the invention.
Figure 14:
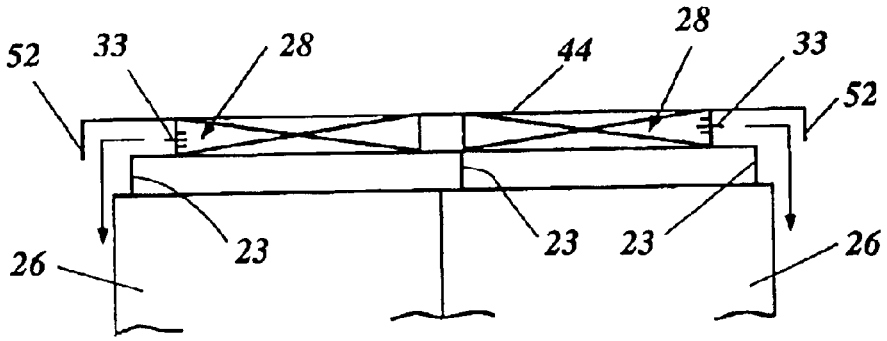
FIG. 14 is a cross sectional view taken along the line 14—14 of FIG. 13.
Figure 15:
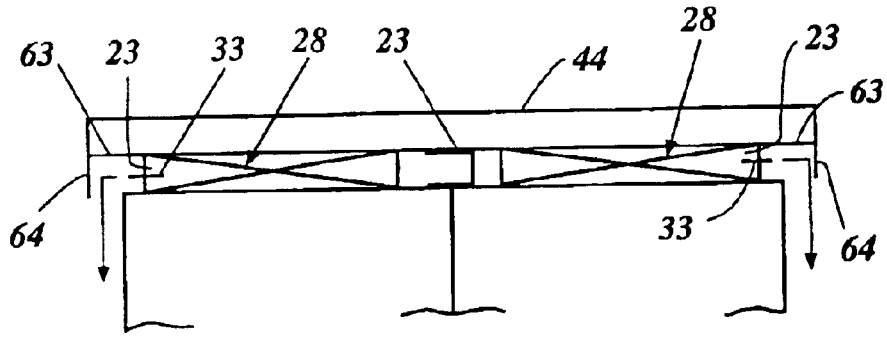
FIG. 15 is a cross sectional view, in part similar to FIG. 14, but showing a third embodiment of the invention.

An arrangement where the air duct and delivery and intake passages extend vertically is shown in FIGS. 13–15. In describing this and subsequent embodiments, where components are the same or substantially the same as those already describes, they are identified by the same reference numerals and will be described further only as is necessary to understand the construction and operation of the respective additional embodiment.

As seen in FIG. 13 and FIG. 14, a rack, indicated generally at 51, has affixed to the inside surface of its side panel 44 an air duct 28. As with the previously described embodiment the rack 51 is a double rack having two rack plate members 26 disposed in the direction of depth. The air duct 28 is formed, like the previous embodiment by two sets corresponding to the two rack plate members 26 in the direction of depth.

The air duct 28 is divided by an air shutter into a delivery passage 29 and an intake passage 31. The delivery passage 29 is formed with a plurality of air outlets 33 arranged in the vertical direction and the intake passage 31 with a plurality of air inlets 34 arranged in the vertical direction. In FIG. 13, symbol E designates a range in which the air outlets 33 are formed and symbol I a range in which the air inlets 34 are formed.

The air purifier 27 is fixed to the lower part of the side panel 44 on the outside surface. The inlet 37 of the air purifier 27 is in communication with the intake passage 31, and its air outlet 38 is in communication with the delivery passage 29.

As shown in FIG. 14, the air outlets 33 formed in the delivery passage 29 of the air duct 28 are shaped such that air is delivered and inducted in the direction perpendicular to the front of the rack 51. Confronting the air outlets 33 in the flow direction of the air is located a bent side edge 52 formed by the side edges of the side panel 44 being bent at right angles. The bent side edge 52 serves as a deflector member by which the delivered air is turned in the direction parallel to the front of the rack 51. The structure around the air inlets 34 is the same as that around the outlets, and air flowing in the direction parallel to the front of the rack 51 is turned in the horizontal direction by the bent edge 51 of the side panel 44 to be introduced to the air inlets 34.

FIG. 15 shows a slight modification in that the air duct 28 may be incorporated between posts 23 arranged in the direction of depth of the rack 21, as in the embodiment. In this embodiment, the air outlets 33 are formed in the side face of the posts23 on the outer sides. The air inlets are formed similarly.

The space produced between the air duct 28 and the inside surface of the side panel 44, is covered by a cover plate 63. On the course of air delivered from the air outlets 33 in the direction perpendicular to the front of the rack 51, is disposed a deflector member 64. The deflector member 64 may be an extension of the bent edge of the side panel 44.

The embodiments shown in FIGS. 13 to 15 differs from the embodiment shown in FIG. 1 to 8 only in that the air duct having delivery and intake passages extends vertically, and the same effect and function as in the earlier embodiment is achieved.

Figure 16:
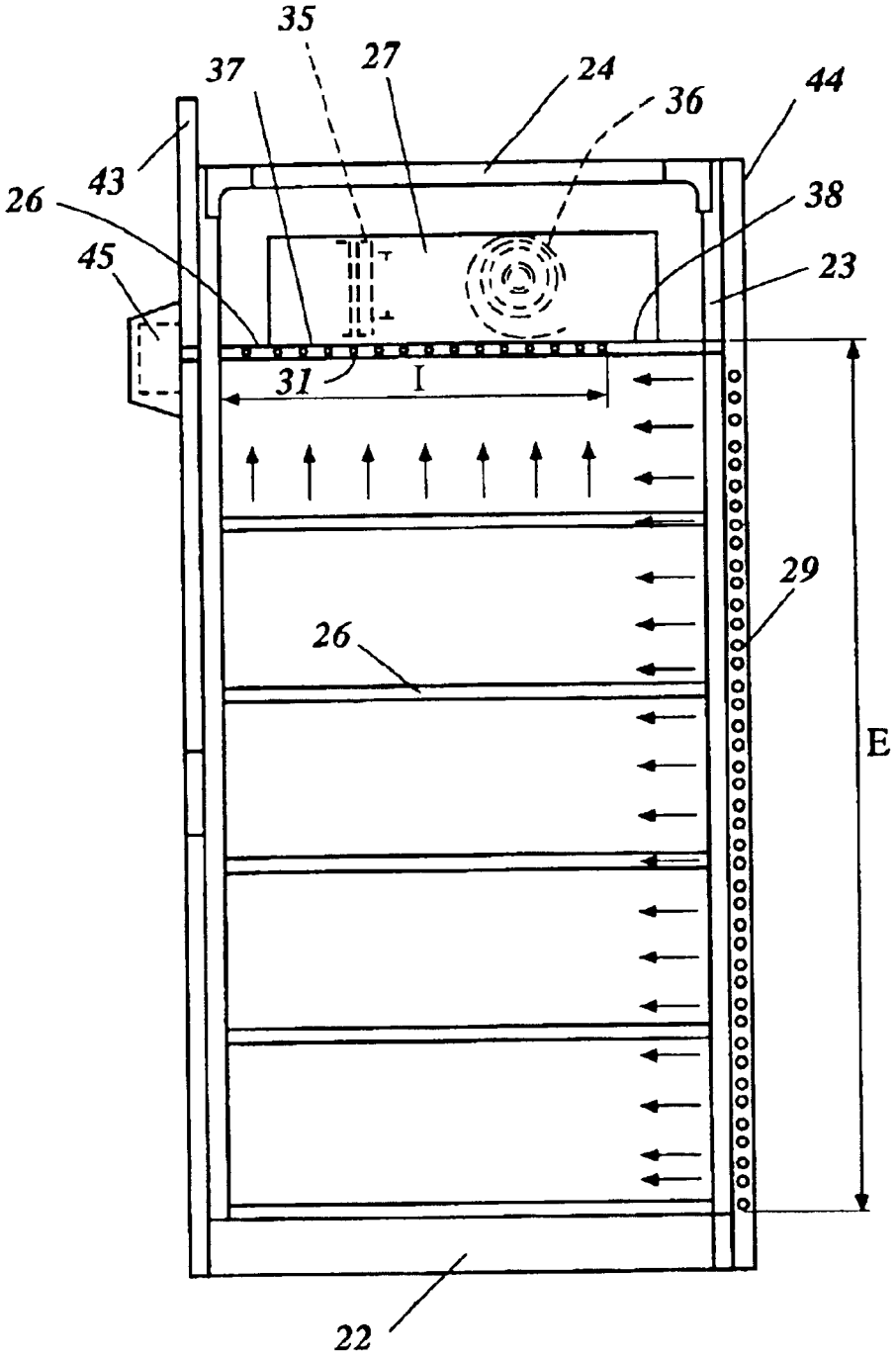
FIG. 16 is a front elevational view, in part similar to FIGS. 1 and 13, but showing a fourth embodiment of the invention.

FIG. 16 shows another embodiment of the invention. In this embodiment the an air duct is divided into two parts, one extending horizontally and the other extending vertically. The horizontally-extending part is used for an intake passage 31 and the vertically extending part functions as the delivery passage 29. More specifically, on the uppermost rack plate members26 of the rack, indicated generally in this embodiment as 71, is mounted an air purifier 27 with titanium oxide filter as photo catalyst 35 and circulating fan 36.

As noted, the intake passage 31 is provided in the rack plate members26, and the delivery passage 29 is provided in the side panel 44. The rack plate members26 constitutes an air inlet forming range I with a portion left open, and the air outlet 38 of the air purifier 27 is in communication with this remaining portion. Also this portion is also in communication with the delivery passage 29.

The intake passage 31 may be configured similar to that in the embodiment shown in FIGS. 1–8. The delivery passage 29 may be configured similar to that in the embodiment shown in FIGS. 13–15.

In the embodiment shown in FIG. 16, although the air duct is divided into horizontal and vertical parts, the intake and delivery passages can be connected almost directly to the intake and delivery ports of the air purifier 27, so that the same effect and function as in the foregoing embodiment can be achieved.

Figure 17:
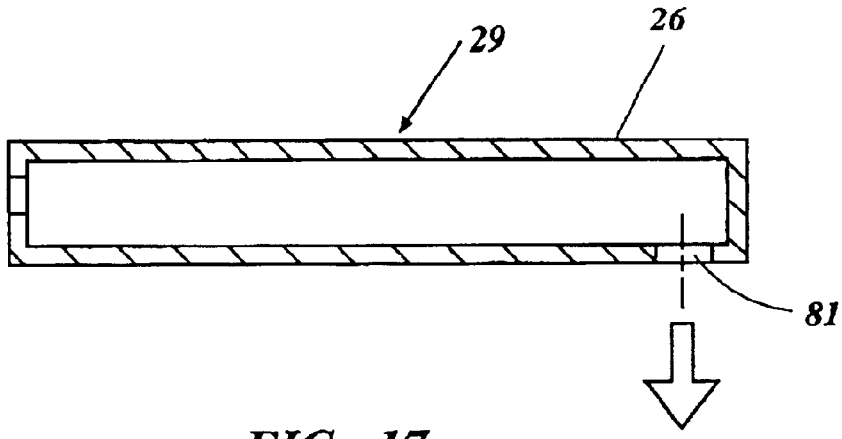
FIG. 17 is a cross sectional view showing another embodiment of formation of the air inlet and discharge openings.
Figure 18:
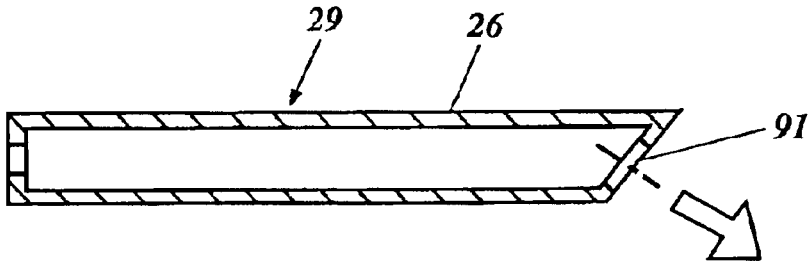
FIG. 18 is a cross sectional view, in part similar to FIG. 17 and showing yet another embodiment of formation of the air inlet and discharge openings.

The air outlets and air inlets are not limited to ones through which air is delivered or drawn horizontally as described in FIGS. 7, 8, 14 and 15. In the example shown in those figures, air is first delivered horizontally and made to hit against a vertical member so as to be indirectly turned downwardly. However, as shown in FIG. 17, air outlets 81 of the delivery passage 29 may be formed to be directed downwardly for the downward air delivery. Also, as shown in FIG. 18, air outlets 91 of the delivery passage 29 may be formed to be directed obliquely downwardly for the obliquely downward air delivery. Likewise, the inlets of the intake passage may be formed as shown in FIG. 7 so that air is drawn from below or obliquely from below the intake passage. Alternatively, air outlets may be configured similar to the air outlets shown in FIG. 17 and FIG. 18 and air inlets similar to the arrangement shown in FIG. 7, and conversely, air inlets may be configured similar to the outlets shown in FIG. 17 and FIG. 18 and air outlets similar to the arrangement shown in FIG 7.

The environment improvement device of this invention can be applied not only to the racks such as shown in the embodiments illustrated, but also to general storage bodies such as a moving rack, a stationary rack, a storage rack, a showcase, a closet, a shoe cupboard and a storeroom. Also it will be understood by those skilled in the art the foregoing description has been that of preferred embodiments of the invention and that various changes and modification may be made without departing from the spirit and scope of the invention as defined by the appended claims.

What is claimed is:

1. A storage device having air purification, said storage device comprising a storage area for storing a stored object and an access opening for placing the stored object within said storage area and for removing the stored object therefrom, said access opening being defined by spaced horizontally spaced members and attached, spaced vertically spaced members, at least one of said members defining an air flow path comprised of an inlet path including a plurality of spaced inlet openings for drawing atmospheric air into said at least one of said members and an outlet path including a plurality of spaced outlet openings for exhausting atmospheric air introduced in said inlet path from said inlet air opening, and an air purification system including at least a device for circulating atmospheric air through the inlet path and the outlet path and an air purification device in the path of the circulated atmospheric air.

2. A storage device having air purification as set forth in claim 1, wherein the air purification system also includes a humidifying element controlling the relative humidity of the circulated air.

3. A storage device having air purification as set forth in claim 1, wherein the inlet openings and the outlet openings all face in the same direction.

4. A storage device having air purification as set forth in claim 3, wherein the inlet and outlet paths are in line with each other and are separated by an air shutter.

5. A storage device having air purification as set forth in claim 4, wherein the flow to and from the inlet and outlet paths is redirected to flow across the access opening to form an air curtain there across by a baffle plate placed in confronting relation thereto.

6. A storage device having air purification as set forth in claim 1, wherein the inlet openings and the outlet openings all are formed in the same member.

7. A storage device having air purification as set forth in claim 6, wherein the inlet openings and the outlet openings all face in the same direction.

8. A storage device having air purification as set forth in claim 7, wherein the inlet and outlet paths are in line with each other and are separated by an air shutter.

9. A storage device having air purification as set forth in claim 8, wherein the flow to and from the inlet and outlet paths is redirected by a baffle plate placed in confronting relation thereto to flow across the access opening to form an air curtain there across.

10. A storage device having air purification as set forth in claim 1, wherein the inlet openings create an air curtain flowing in one direction across a first portion of the access opening and the outlet openings create an air curtain flowing in a direction opposite to said first direction across a second portion of said access opening.

11. A storage device having air purification as set forth in claim 1, wherein the inlet openings and the outlet openings each are formed in respective members that are perpendicularly related to each other.

12. A storage device having air purification as set forth in claim 10, wherein the inlet openings and the outlet openings all face in the same direction.

13. A storage device having air purification, said storage device comprising a storage area for storing a stored object and an access opening for placing the stored object within said storage area and for removing the stored object therefrom, said air purification comprising an inlet path including an inlet air opening for drawing atmospheric air into said storage device in a direction extending across said access opening, an outlet path including an outlet air opening for exhausting atmospheric air introduced in said inlet path from said inlet air opening in a direction extending across said access opening, and an air purification system including at least a device for circulating atmospheric air through the inlet path and the outlet path, an air purification device in the path of the circulated atmospheric air and a humidifying element controlling the relative humidity of the circulated air.

14. A storage device having air purification, said storage device comprising a storage area for storing a stored object and an access opening for placing the stored object within said storage area and for removing the stored object therefrom, said access opening being defined by spaced horizontally spaced members and attached, spaced vertically spaced members, at least one of said members defining an air flow path comprised of an inlet path including a plurality of spaced inlet openings for drawing atmospheric air into said at least one of said members and an outlet path including a plurality of spaced outlet openings for exhausting atmospheric air introduced in said inlet path from said inlet air opening, and an air purification system including at least a device for circulating atmospheric air through the inlet path and the outlet path and an air purification device in the form of a titanium oxide filter the path of the circulated atmospheric air.

* * * * *